US010309075B2

(12) United States Patent
Schmertmann et al.

(10) Patent No.: US 10,309,075 B2
(45) Date of Patent: Jun. 4, 2019

(54) METHOD AND APPARATUS FOR INCREASING THE FORCE NEEDED TO MOVE A PILE AXIALLY

(75) Inventors: John Schmertmann, Gainesville, FL (US); Jon Sinnreich, Gainesville, FL (US)

(73) Assignee: LOADTEST, INC., Gainesville, FL (US)

( * ) Notice: Subject to any disclaimer, the term of this patent is extended or adjusted under 35 U.S.C. 154(b) by 0 days.

(21) Appl. No.: 11/584,967

(22) Filed: Oct. 23, 2006

(65) Prior Publication Data

US 2007/0092341 A1 Apr. 26, 2007

Related U.S. Application Data

(60) Provisional application No. 60/779,825, filed on Mar. 7, 2006, provisional application No. 60/729,127, filed on Oct. 21, 2005.

(51) Int. Cl.

| | |
|---|---|
| ***E02D 5/22*** | (2006.01) |
| ***E02D 27/16*** | (2006.01) |
| ***E02D 27/28*** | (2006.01) |
| ***E02D 35/00*** | (2006.01) |

(52) U.S. Cl.

CPC ..... *E02D 27/16* (2013.01); *E02D 27/28* (2013.01); *E02D 35/00* (2013.01)

(58) Field of Classification Search

CPC ..... E02D 27/16; E02D 27/28; E02D 35/00
USPC ..... 405/231, 232, 255, 262, 284, 286
See application file for complete search history.

(56) References Cited

U.S. PATENT DOCUMENTS

| | | | | |
|---|---|---|---|---|
| 315,384 | A * | 4/1885 | Boynton | 405/30 |
| 2,645,090 | A | 7/1953 | Kinneman et al. | |
| 3,107,495 | A | 10/1963 | Plodowski | |
| 3,483,707 | A | 12/1969 | Meheen | |
| 3,602,000 | A | 8/1971 | Meheen | |
| 3,899,891 | A | 8/1975 | Kelly et al. | |

(Continued)

FOREIGN PATENT DOCUMENTS

| | | |
|---|---|---|
| EP | 0 363 952 A2 | 4/1990 |
| EP | 0 478 863 A1 | 4/1992 |

(Continued)

OTHER PUBLICATIONS

Braja Das, Principles of Foundation Engineering, 4th ed, 1999.*

(Continued)

*Primary Examiner* — Benjamin F Fiorello
(74) *Attorney, Agent, or Firm* — Saliwanchik, Lloyd & Eisenschenk

(57) ABSTRACT

The subject invention pertains to a method and apparatus for inducing a lateral load for the purpose of increasing the force needed to lift a pile and/or increasing the downward and/or lateral load bearing capacity of a pile. The pile can be a driven or pushed displacement pile, a driven or pushed non-displacement pile, any type of bored pile, or any combination. In an embodiment, the subject invention can enhance pile performance by increasing (prestressing) permanently the lateral pressure between a pile and its surrounding soil. The subject invention can provide directional displacement through induced lateral loading of installed piles. Embodiments of the subject invention can incorporate embedded lateral loads in one or more piles.

8 Claims, 13 Drawing Sheets

(56) References Cited

U.S. PATENT DOCUMENTS

| | | | |
|---|---|---|---|
| 3,963,056 | A | 6/1976 | Shibuya |
| 4,043,133 | A | 8/1977 | Yegge |
| 4,094,539 | A | 6/1978 | Reimart |
| 4,373,837 | A | 2/1983 | Lin et al. |
| 4,604,003 | A | 8/1986 | Francoeur |
| 4,627,769 | A | 12/1986 | Lee |
| 5,433,557 | A | 7/1995 | Houghton |
| 5,908,268 | A | 6/1999 | Yabuuchi |
| 6,409,433 | B1 | 6/2002 | Hubbell et al. |
| 6,435,777 | B1 | 8/2002 | Yukio et al. |
| 6,665,990 | B1 | 12/2003 | Cody et al. |
| 2005/0019103 | A1 | 1/2005 | Brooks |
| 2005/0031418 | A1 | 2/2005 | Whitsett |
| 2005/0117977 | A1 | 6/2005 | Rasmussen |

FOREIGN PATENT DOCUMENTS

| | | |
|---|---|---|
| GB | 2 147 039 | 5/1985 |
| GB | 2 152 121 | 7/1985 |
| JP | 56125528 | 10/1981 |
| JP | 61010626 A | 1/1986 |
| JP | 5140931 | 6/1993 |
| JP | 2002363977 | 12/2002 |
| WO | WO-2001-046526 | 6/2001 |

OTHER PUBLICATIONS

Machine Translation, EP 0363952; Apr. 18, 1990.*

Patterson, D., "Pole embedment to resist lateral load", *Civil Engineering*, Jul. 1958, p. 69.

Schmertmann, J. "Discussion of 'Ultimate Lateral Resistance to Piles in Cohensionless Soils' by Linyang Zhang, Francisco Silva, and Ralph Grismala", *Journal of Geotechnical and Geoenvironmental Engineering*, Aug. 2006, pp. 1108-1109.

Schmertmann, J., et al., "*East Pascagoula River Bridge Test Program*—vol. 1", Apr. 30, 1998, prepared for the Mississippi Department of Transportation. (Excerpt—pp. 40-41, Figure 2-1, Preliminary Summary Table, Figures 10-1, 10-18, 10-19, 10-22, 10-23, 10-26, 10-28, 10-29).

Zhang, L., et al., "Ultimate Lateral Resistance to Piles in Cohensionless Soils", *Journal of Geotechnical and Geoenvironmental Engineering*, Jan. 2005, pp. 78-83, vol. 131, No. 1.

* cited by examiner

METHOD AND APPARATUS FOR INCREASING THE FORCE NEEDED TO MOVE A PILE AXIALLY

CROSS-REFERENCE TO RELATED APPLICATIONS

The present application claims the benefit of U.S. Provisional Patent Application Ser. No. 60/779,825, filed Mar. 7, 2006. The present application also claims the benefit of U.S. Provisional Patent Application Ser. No. 60/729,127, filed Oct. 21, 2005. Both applications are incorporated by reference herein in their entirety, including any figures, tables, or drawings.

FIELD OF THE INVENTION

Embodiments of the invention relates to a method and apparatus to increase the force needed to lift a pile and/or to increase the load bearing capacity of the pile.

BACKGROUND OF INVENTION

Piles, usually made out of concrete, are generally used to form the foundations of buildings or other large structures. A pile can be considered a rigid or a flexible pile. Typically a short pile exhibits rigid behavior and a long pile exhibits flexible behavior. The criteria for rigid and flexible behavior depend on the relative stiffness of a pile with respect to the soil and are known in the art. The purpose of a pile foundation is to transfer and distribute load. Piles can be inserted or constructed by a wide variety of methods, including, but not limited to, impact driving, jacking, or other pushing, pressure (as in augercast piles) or impact injection, and poured in place, with and without various types of reinforcement, and in any combination. A wide range of pile types can be used depending on the soil type and structural requirements of a building or other large structure. Examples of pile types include wood, steel pipe piles, precast concrete piles, and cast-in-place concrete piles, also known as bored piles, augercast piles, or drilled shafts. Augercast piles are a common form of bored piles in which a hollow auger is drilled into the ground and then retracted with the aid of pressure-injected cementatious grout at the bottom end, so as to leave a roughly cylindrical column of grout in the ground, into which any required steel reinforcement is lowered. When the grout sets the pile is complete. Piles may be parallel sided or tapered. Steel pipe piles can be driven into the ground. The steel pipe piles can then be filled with concrete or left unfilled. Precast concrete piles can be driven into the ground. Often the precast concrete is prestressed to withstand driving and handling stresses. Cast-in-place concrete piles can be formed as shafts of concrete cast in thin shell pipes that have been driven into the ground. For the bored piles, a shaft can be bored into the ground and then filled with reinforcement and concrete. A casing can be inserted in the shaft before filling with concrete to form a cased pile. The bored piles, cased and uncased, and augercast, can be considered non-displacement piles.

Often a pile is constructed to withstand various external lateral and eccentric loads. The external lateral and eccentric loads can result from high winds, rough waves or currents in a body of water, earthquakes, strikes by one or more large masses, and other external forces. The external lateral forces on structures can induce moments, which the foundations must resist. If the foundation incorporates piles, some of the piles can experience additional compression and others reduced compression or tension to supply the required additional moment resistance. Typically axial load testing or other axial capacity correlations are performed to design a pile capacity. Often the additional moment resistance requires additional pile size, pile length, and/or pile number.

BRIEF DESCRIPTION OF DRAWINGS

FIG. 1A shows the general configuration; FIG. 1B shows the application of a tensioning force to pull the pile heads together; FIG. 1C shows the locked in lateral pre-stressing of the adjacent piles shown in FIG. 1B; FIG. 1D shows the application of a tensioning force to push the pile heads apart; and FIG. 1E shows the locked in lateral pre-stressing shown in FIG. 1D.

FIG. 2A shows the adjacent capped piles; FIG. 2B shows the general configuration for applying a tensioning force; and FIG. 2C shows the locked in lateral pre-stressing of the pile caps.

FIG. 3A shows the general configuration; FIG. 3B shows the application of a tensioning force; and FIG. 3C shows the locked in lateral pre-stressing of the piles.

FIG. 10A shows a top view of the group of 6 piles surrounding a sand zone and FIG. 10B shows a cross section of the 6 pile arrangement shown in FIG. 10A through line s', so as to show two of the piles.

FIG. 12A shows a pile with its lower portion deviating laterally; FIG. 12B shows a pile subjected to an axial tension loading; and FIG. 12C shows a pile subjected to axial compression loading.

DETAILED DISCLOSURE OF THE INVENTION

Figure 1A:
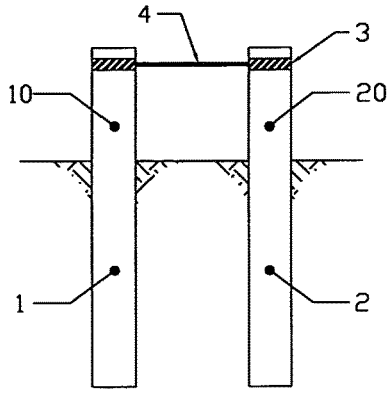
FIGS. 1A-1E show an embodiment for a pre-cap tensioning of an embedded load arrangement using two adjacent piles in accordance with the subject invention.

Embodiments of the subject invention pertain to a method and apparatus for increasing the force needed to lift a pile and/or increasing the downward and/or lateral load bearing capacity of a pile. Embodiments of the invention involve a method and apparatus for permanently inducing lateral loads with respect to one or more piles for the purpose of increasing the force needed to lift a pile and/or increasing the downward and/or lateral load bearing capacity of a pile. Such permanent inducement of lateral loads with respect to one or more piles can be accomplished in a variety of ways, including applying such lateral loads via a mechanism that allows adjustment of the magnitude and/or direction of the lateral load, applying such lateral loads via a static structure (e.g. a pile cap), and applying such lateral load via a mechanism that allows the lateral load to be applied and unapplied, depending on the situation. In an embodiment, the mechanism for applying the lateral load can apply the lateral load in a continuous fashion with no need for further input from a user and with no need for input of additional energy. Such a mechanism can be considered passive rather than active.

Under certain circumstances, piles subjected to lateral loading can have additional axial capacity due to the lateral loading itself and the foundation incorporating the piles may need less or possibly no additional axial capacity. In embodiments, lateral loads can induce additional horizontal soil reaction forces against a pile. In frictional soils, these horizontal soil reaction forces can result in additional axial tension and compression side shear resistance. If this additional resistance exceeds that lost due to any loss of soil/pile contact area and/or pressure resulting from the lateral loading, then the axial capacity can increase. All soils and rocks are frictional. Sands respond so immediately. Clays, especially compressible clays, have to drain first and as they drain they become progressively more frictional in behavior. For the long time lateral load application embodied in embodiments of this invention, clays also gain the lateral load benefits, as do all soils.

Specific embodiments of the invention can enhance pile performance by prestressing the soils surrounding the pile. Embodiments of the invention can provide directional displacement through induced lateral loading of installed piles. Embodiments of the invention can incorporate embedded lateral loads. Embodiments of the invention can incorporate embedded eccentric loading. The subject invention can be applicable to any foundation element in soil with an effective friction angle greater than zero to support structural loads. Embodiments of the invention can provide directional displacement of one or more piles by induced lateral loading of installed piles.

In embodiments of the subject invention, a pile can be stressed with an embedded lateral load. The pile can be, for example, bored cast concrete with or without a casing, cast-in-place concrete, driven precast concrete, or driven steel tubular piles. Piles can be constructed using the methods known in the art, including driven and bored piles (drilled shafts), vertical and inclined (plumb and battered) piles, singly and in groups. The piles can be located partially or wholly in the ground. Embodiments of the subject invention can use rigid piles, flexible piles, and/or a combination of rigid and flexible piles. In an embodiment, a plurality of piles can be formed into pile groups preloaded in more than one direction. In a specific embodiment, a pile group can incorporate a plurality of piles and at least two of the plurality of piles can have lateral loads applied in different directions. In another embodiment, two or more of the piles in the pile group can be used to apply a force to another pile in the pile group. The piles of the pile groups can have different lengths and/or different cross-sectional areas. One embodiment of the subject invention can use piles constructed with conduits for threading tensioning strands. Another embodiment of the subject invention can use piles constructed with expansion elements.

In an embodiment, the embedded lateral loading of one or more piles can increase the force needed to lift the one or more piles. In a further embodiment, the embedded lateral loading of one or more piles can increase the downward load capacity of the one or more piles. In yet a further embodiment, the embedded lateral loading of one or more piles can increase the lateral load capacity of the one or more piles.

In additional embodiments, the subject method and apparatus can apply tensioning or compressing loads within the pile to create a moment that "acts" as a lateral load. The lateral force applied to a pile, to a group of two or more piles, or within a group of two or more piles, increases the force needed to lift the pile(s) and/or increases the downward and/or lateral load bearing capacity of each pile. The increased force needed to lift or otherwise move the pile can be due, at least in part, to the increased shear force exerted on the pile by the surrounding ground as the lateral force the ground exerts on the pile increases to "counteract" the lateral force exerted on the pile.

Adjacent or non-adjacent piles can be used to apply externally the lateral forces to each other through pulling or pushing against each other. A horizontal force is not necessary because an eccentrically applied internal pile tension or compression can also supply a bending moment in the pile that simulates an external lateral loading.

Figure 1B:
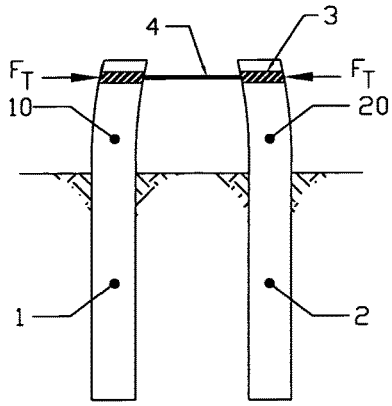
Figure 1C:
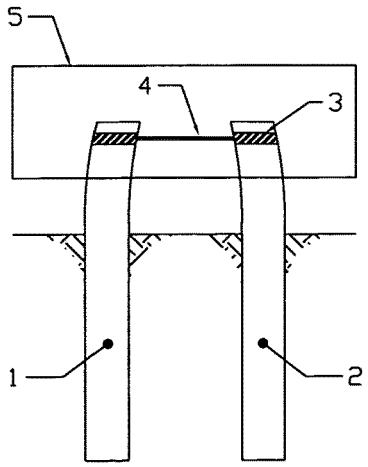
Figure 1D:
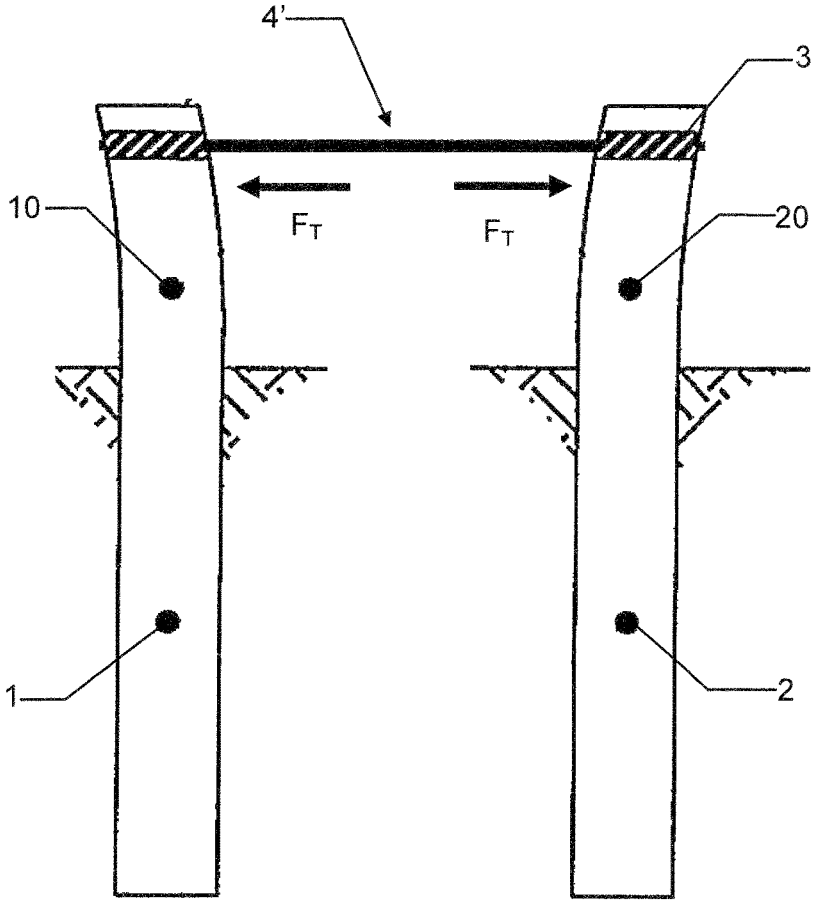
Figure 1E:
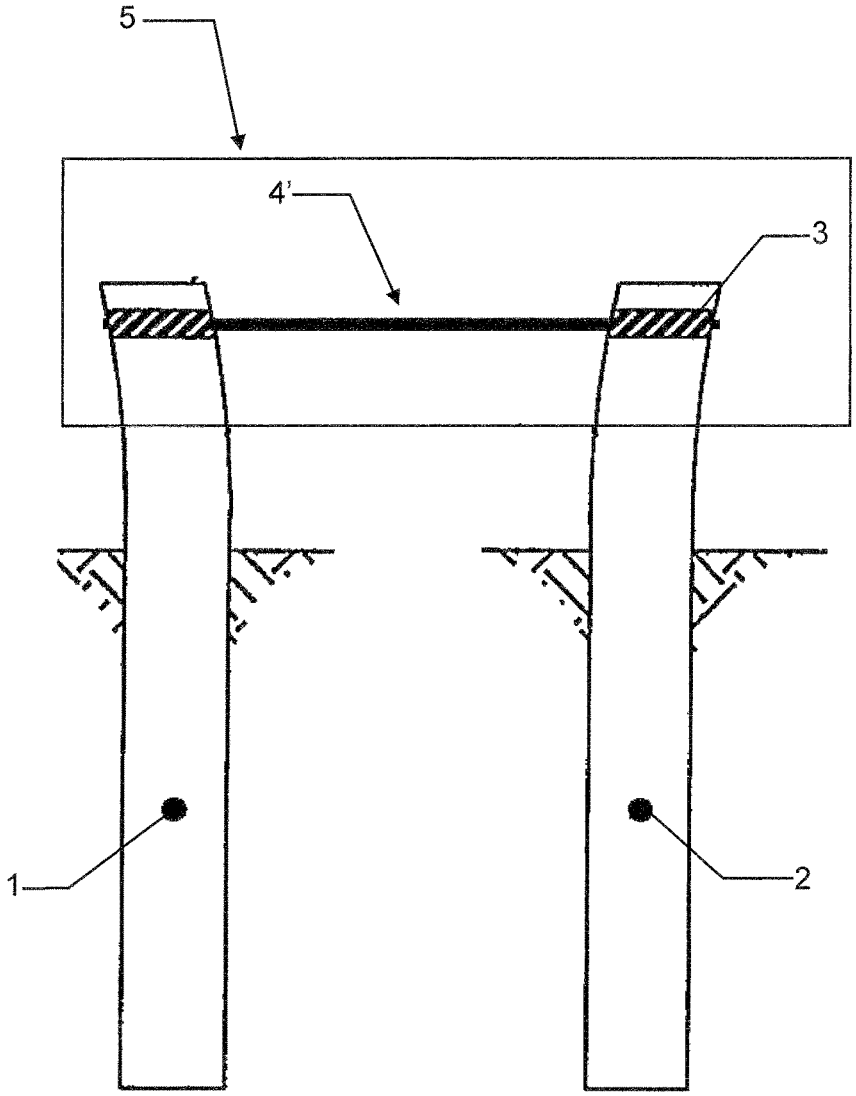

FIGS. 1A-1C show an embodiment for a pre-cap tensioning, or lateral pre-stressing, of an embedded load arrangement using two piles 1 and 2. Referring to FIG. 1A, the two piles 1 and 2 can be located adjacent to one another. The bearing collars 3 can be installed on the pile head 10 and 20. In an embodiment the bearing collars 3 can be installed at or near the top of each pile 1 and 2, or at other locations such as near ground level. Tensioning strands 4 can be used to connect the bearing collars 3 of the piles 1 and 2. Embodiments having a plurality of piles can be connected in various configurations according to soil specifications. In additional embodiments, the lateral forces can be applied below ground level. Once the tensioning strands 4 are connected to the bearing collars 3, a tensioning force $F_T$ can be applied to the strands 4 until a desired lateral load is applied. The tensioning force $F_T$ can pull the pile heads 10 and 20 together. Alternately, a force can be applied to push the pile heads 10 and 20 apart. FIG. 1B shows the application of a tensioning force $F_T$ to pull the pile heads 10 and 20 together. FIG. 1D shows the application of a tensioning force $F_T$ to push the pile heads 10 and 20 apart. In one embodiment, the tensioning strands 4 can be locked in place by grouting, in another, with anchors (not shown). In a further embodiment, as shown in FIG. 1C and FIG. 1E, the desired lateral load can be locked in by constructing a cap 5 around the pile heads 10 and 20. Once the lateral load is locked in, a downward load can be applied to the foundation incorporating the piles, which has increased load carrying capacity due to the locked in lateral load.

Figure 2A:
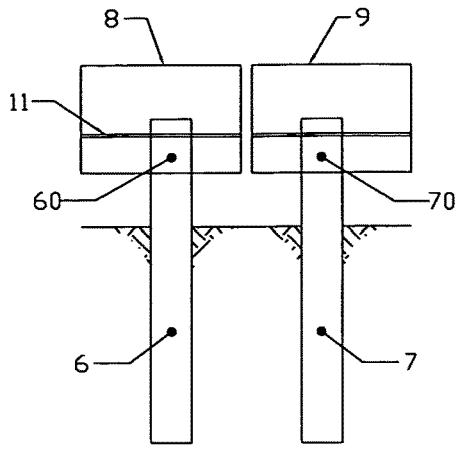
FIGS. 2A-2C show an embodiment for a post-cap tensioning of an embedded load arrangement using two adjacent piles with pile caps in accordance with the subject invention.
Figure 2B:
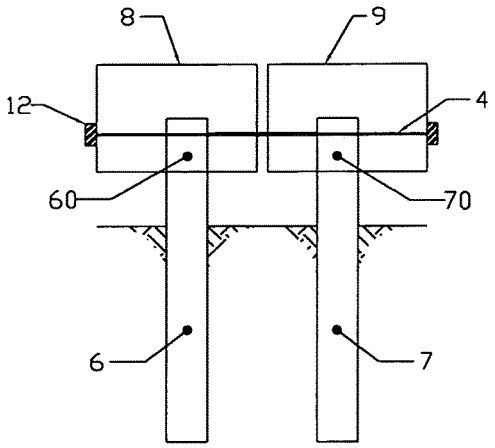
Figure 2C:
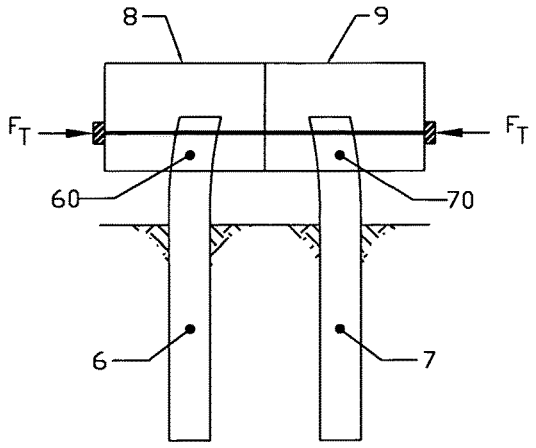

FIGS. 2A-2C show an embodiment for a post cap tensioning, or lateral prestressing, of an embedded load arrangement using two piles. Further embodiments can incorporate additional piles. The two piles 6 and 7 can be located adjacent to one another. Referring to FIG. 2A, individual pile caps 8 and 9 can be constructed on top of each pile head 60 and 70. Conduits 11 can be incorporated in the pile caps 8 and 9 during construction. In an embodiment, the individual pile caps 8 and 9 can be constructed such that a small gap is left between adjacent pile cap blocks 8 and 9. Referring to FIG. 2B, tensioning strands 4 can be threaded through the conduits 11 in the pile caps in order to connect the individual pile cap blocks 8 and 9. The conduits 11 may or may not go through the pileheads 60 and 70. Bearing plates 12 can be attached to the ends of the strands 4. As shown in FIG. 2C, a tensioning force $F_T$ can be applied using the tensioning strands 4 to pull the pile caps 8 and 9 together. In an embodiment, the application of the tensioning force $F_T$ to a desired lateral load can cause the gaps between the pile caps 8 and 9 to close. The desired lateral load can then be locked into place by grouting or with anchors.

Figure 3A:
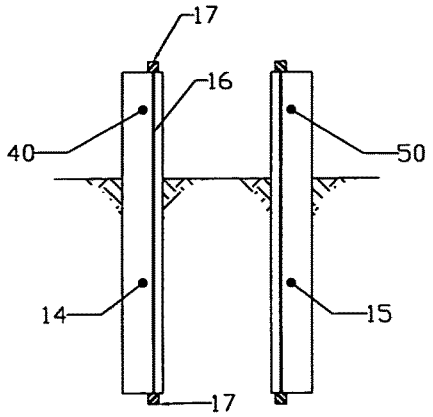
FIG. 3A-3C show an embodiment for an eccentric pile tensioning of an embedded load arrangement using two adjacent piles.
Figure 3B:
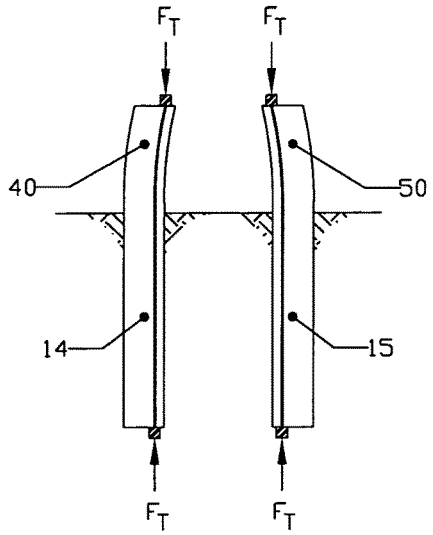
Figure 3C:
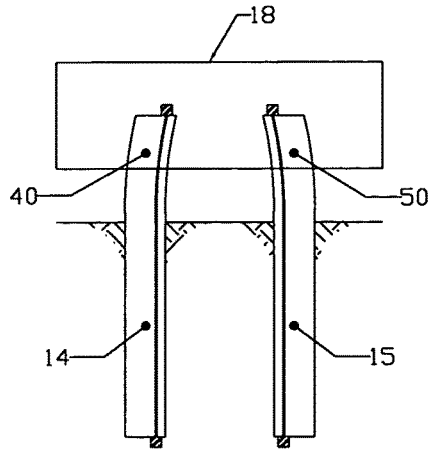

FIGS. 3A-3C show an embodiment for an eccentric pile tensioning, or eccentric axial pre-stressing, of an embedded load arrangement using two piles. Alternative embodiments can utilize a single pile or more than two piles. The eccentric pile tensioning can create a moment that "acts" as a lateral load. In an embodiment, one or more piles can have a conduit with pre-attached anchor plates and tensioning strands in an eccentric alignment, such that the conduit with a threaded tensioning strand is not situated at or in the geometric center of the pile in order to perform the eccentric loading. Referring to FIG. 3A, piles 14 and 15 can be constructed with a conduit 16, tensioning strand 4, and pre-attached anchor plates 17. Piles 14 and 15 can be pre-cast, cast-in-place, or bored piles. Once pre-cast piles are driven into the ground, or after cast-in-place or bored piles' concrete reaches an adequate strength, a tensioning force $F_T$ can be applied to the tensioning strands 4 until a moment is created that "acts" as a desired lateral load. The tensioning force $F_T$ can appear to pull the tops of piles 14 and 15 together, or, alternatively, the tensioning force $F_T$ can appear to push the tops of piles 14 and 15 apart. FIG. 3B shows the application of a tensioning force $F_T$ to pull the pile heads 40 and 50 together. In one embodiment, the tensioning strands 4 can be locked in place by grouting, in another, with anchors (not shown). In a further embodiment, as shown in FIG. 3C, the desired lateral load can be locked in by constructing a cap 18 around the pile heads 40 and 50.

Figure 5:
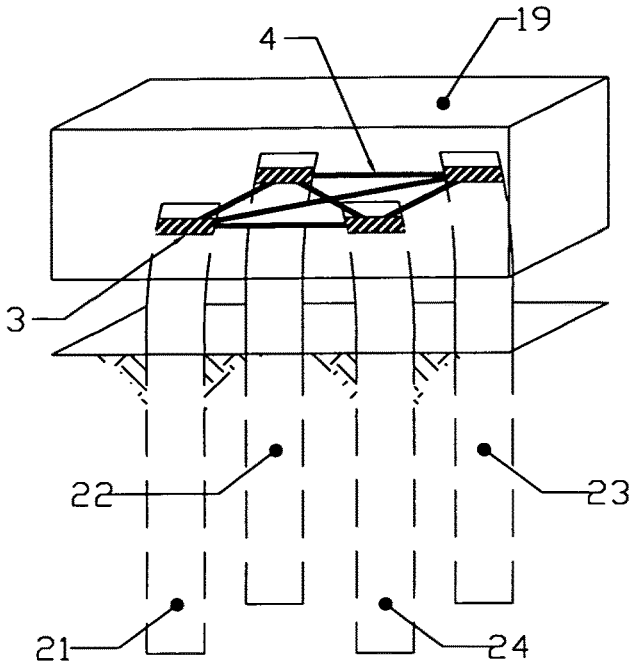
FIG. 5 shows an embodiment of an embedded load for a 4 pile arrangement.
Figure 6:
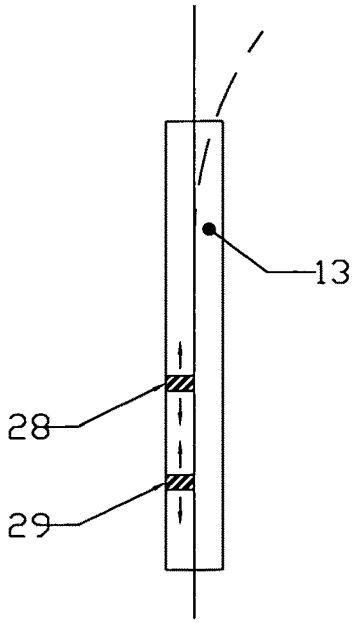
FIG. 6 shows an imbedded lateral load using an expansive element in accordance with an embodiment of the subject invention.
Figure 7:
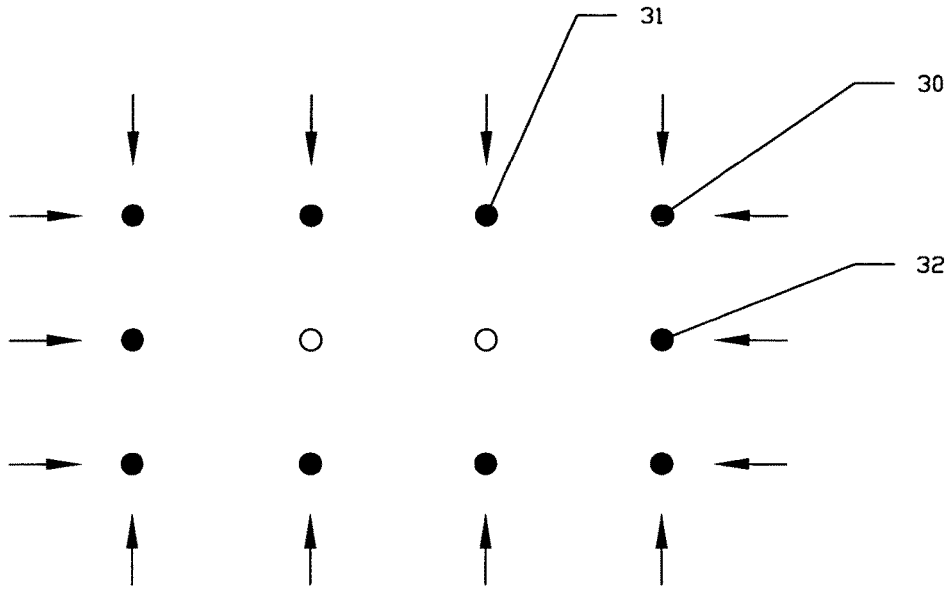
FIG. 7 shows a foundation area arrangement for embedded lateral loading in accordance with an embodiment of the subject invention.

In an embodiment, multiple piles can act in concert as a single "pile structure". For example, as shown in FIG. 5, four piles 21, 22, 23, and 24 can be located together in, for example, a square formation. The piles can be constructed using the methods shown in FIGS. 1-3, and 6. Using the method shown in FIG. 1, the piles 21, 22, 23, and 24 can be fitted with bearing collars 3. Tensioning strands can be connected between adjacent piles and/or non-adjacent piles. Referring to FIG. 5, the piles 21, 22, 23, and 24 can be connected, for example, at a diagonal from each other. Alternatively, or in addition, the piles 21, 22, 23, and 24 can be connected such that the tensioning strands 4 form a square. In an embodiment, a single pile cap 19 can lock in the desired lateral load. In a further embodiment, a whole foundation area can be pre-stressed. A pile group can be formed from a plurality of piles, as shown in FIG. 7, viewed from the top of the piles. The outer piles can be preloaded in more than one direction. For example, outer pile 30 can be preloaded in the direction of both outer pile 31 and outer pile 32. The preloading can be accomplished by, for example, the technique for lateral loading described above. The performance of the pre-stressing of the pile group can be similar to that achieved by compaction piles, which increase the density of, and/or the lateral stresses against the soils between the piles.

Embodiments can incorporate multiple lateral loads to a single pile. These multiple lateral loads can be applied at different vertical positions. In a further embodiment to the embodiment shown in FIGS. 1A-1C, an additional force can be applied to one or both of piles 1 and 2. For example, a rigid body can be placed between piles 1 and 2 so as to apply a force to push piles 1 and 2 away from each other. This rigid body can be placed at or near ground level in a specific embodiment.

Embodiments of the subject invention can incorporate expansive elements such as, for example, one or more hydraulic jacks or other load applying mechanisms. In a specific embodiment, one or more O-cell® jacks can be utilized. FIG. 6 shows an embodiment of a pile 13 incorporating two hydraulic jacks 28 and 29 in order to apply the embedded lateral load. As illustrated in FIG. 6, the internal moment in a pile, which produces the pile bending and a lateral loading of the pile, can also be produced by eccentric expansive elements within the pile. These can be of any type, including jacks and bags expanded by a fluid such a cementations grout. FIG. 6 illustrates the use of two O-cell® jacks 28 and 29. This method may involve the cracking of the pile to permit the necessary eccentric expansion, and may include a method for healing the pile, such as post-expansion grouting of any cracks.

Figure 8:
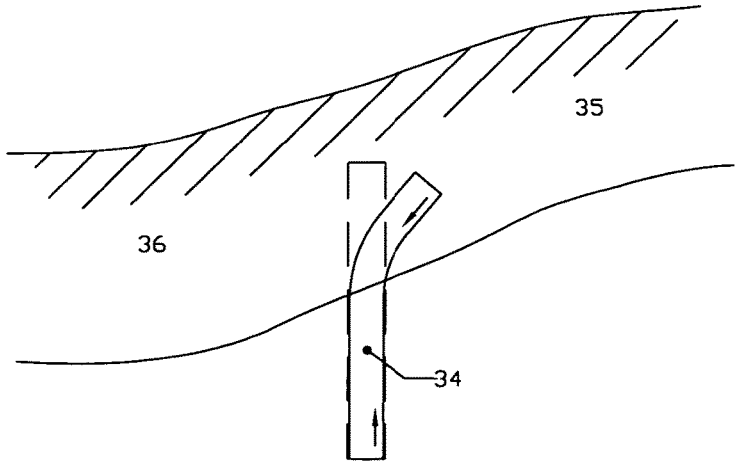
FIG. 8 shows an embodiment of embedded piles for slope stability in accordance with the subject invention.

Referring to FIG. 8, one or more piles can be directionally bent, externally or internally, to improve slope stability. Bending is in the upslope direction to exert a prestressing upslope force on the soil mass 35 to be stabilized, which wholly or partially counteracts the downslope forces tending to move the upslope soil mass 35, and any encompassed or attached structures, downslope 36. For example as shown in FIG. 8, pile 34 is directionally bent in the upslope direction. One or more piles can be placed across the boundary of unstable/stable soil or rock such that the part in stable material supports the reinforcing effect of the pile(s) in the usually overlying unstable material.

Figure 10A:
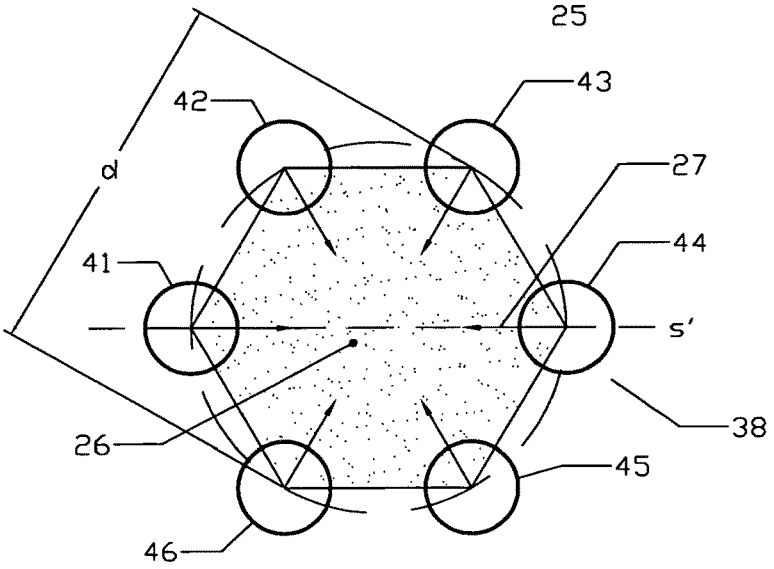
FIGS. 10A and 10B show an embodiment of a 6 pile arrangement having an embedded load.
Figure 10B:
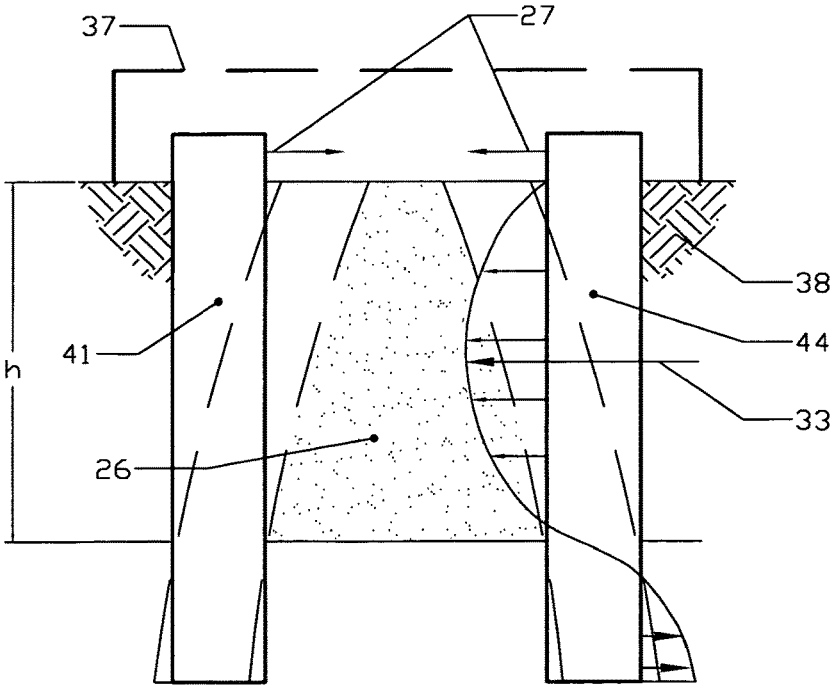

In an embodiment, an inward lateral load can be applied to one or more piles of a group of piles surrounding a zone of liquefiable sand. Referring to FIGS. 10A-10B, a group of six piles 25 can be located around an interior zone of liquefiable sand 26 or other liquefiable soil. The application of an inward lateral load 27 on each of the six piles can increase the horizontal stresses within the interior zone of sand 26, which significantly increases the zone of sand's resistance to liquefaction. Accordingly, the application of an inward lateral load on the piles can help prevent sand or soil from liquefying in response to earthquake-induced ground motions.

Specifically, FIG. 10A shows an embodiment using a group of six piles 25 surrounding a sand zone 26 of diameter d. A surrounding sand zone 38 can surround the group of six piles 25. An inward lateral force 27 can be applied to each pile in accordance with any of the methods described above. A pile cap (shown in dotted lines as pile cap 37 in FIG. 10B) can be constructed about the group of six piles 25. The inward forces applied to each pile 41, 42, 43, 44, 45, and 46 and the depth h of the sand zone 26 results in an increased horizontal stress. As shown in FIG. 10B, the depth h of the sand zone 26 results in an increased horizontal stress 33 on a pile 44. In a preferred embodiment, the depth of each pile should equal or exceed the design depth h of liquefiable sand. In a specific embodiment, where h=34 ft for a hexagonal group of six piles, the depth of each pile can be 50 ft for a group diameter, d, of 20 ft, but other groups, depths, and diameters can be used.

Figure 11:
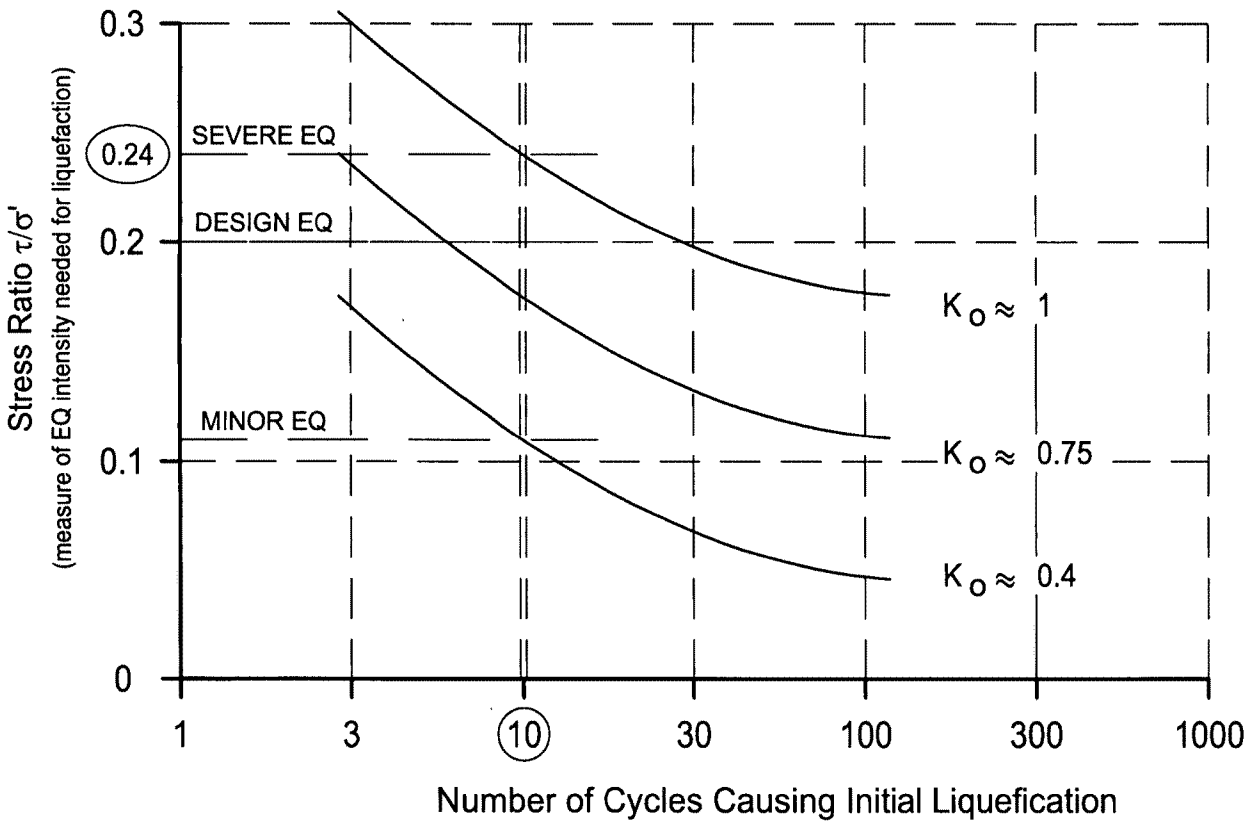
FIG. 11 shows a graph of the influence of initial principle stress ratio on stresses causing liquefaction in simple shear tests.

FIG. 11 shows a graph from Seed and Peacock, ASCE Journal of Soil Mechanics & Foundation Engineering, August 1971. This graph shows the large increase in the resistance of sand to liquefaction under cyclic loading as a result of increasing $K_0$ from 0.4 to 1, where $K_0$ is a dimensionless measure of lateral stress in sand. This greatly increases the magnitude of an earthquake that can partially or fully liquefy the sand. For example, as shown in FIG. 11, if the design number of equivalent cycles=10, and the design EQ stress ratio=0.20, then raising $K_0$ from 0.4 to 1.0 will prevent liquefaction because it would require a stronger EQ to produce the required stress ratio of 0.24.

In addition, separate calculations show that it is practical to construct a group of six piles 25, as shown FIG. 10, that can increase $K_0$ to a depth of 50 ft. from a typical 0.4 in liquefiable sand to 1.0. The value of $K_0$ can be increased by this embodiment so that the surrounded sand 26 will not liquefy during the design earthquake. Alternatively, any suitable surrounding group of piles can be used. The surrounded sand and the surrounding piles combine to form a large "column" of diameter d that can provide reliable foundation support even if the surrounding sand should partially or fully liquefy. In this embodiment, the individual piles can retain most or all of their capacity. In contrast, without a suitable surrounding group of piles such as the group of six piles, individual piles would lose most or all of their capacity if the surrounded sand also liquefied.

Figures 12A, 12B, 12C:
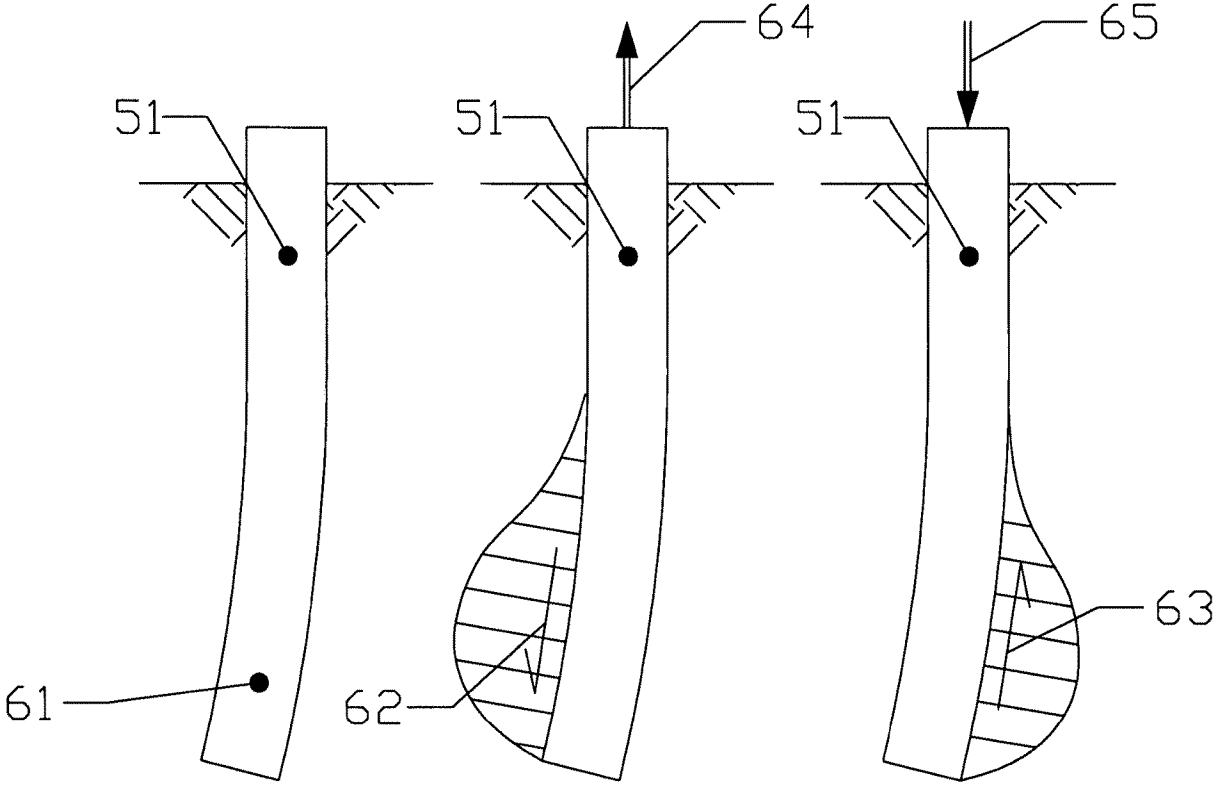
FIGS. 12A-12C show additional lateral loading on a pile in accordance with an embodiment of the subject invention.

FIGS. 12A-12C show an embodiment with deviations from the vertical of the lower part of a pile. In this embodiment vertical loading causes an additional lateral loading on the pile, which as with previous embodiments, increases its axial capacity. This deviation from the vertical can be achieved by a planned drilled deviation from a plumb pile (vertical pile axis) during the construction of the lower part of a bored pile, or any other means for achieving a similar deviation during the insertion or construction of any type pile, followed by the axial loading of the pile. The additional lateral loading and resulting increase in axial capacity occurs along the deviation simultaneously with the axial loading, as shown in FIGS. 12A-12C. FIG. 12A shows a pile 51 with its lower portion 61 deviating laterally from vertical. FIG. 12B shows the pile 51 subjected to an axial tension loading 64, which produces an increased pile/soil pressure and resisting side shear 62. FIG. 12C shows the pile 51 subjected to an axial compression loading 65, which produces an increased pile/soil pressure and resisting side shear 63. The upper part of the pile can remain plumb to retain its full resistance to an externally applied lateral loading.

Embodiments of the invention can estimate the increase of the tension force needed to lift a pile having simultaneous lateral loading. Applying a lateral load can dramatically increase axial pullout capacity. In an embodiment, the estimates at the increase of the tension force needed to lift a pile having simultaneous lateral loading and/or the side shear part of the compressive increase in load capacity can be arrived at, for example, using an analytical procedure based on the following equations (1)-(4), derived utilizing the design method in Rutledge (Rutledge, P. C. (1947) nomograph, ASCE *CIVIL ENGINEERING*, July 1958, p 69). However, any suitable procedure may be used for this purpose.

$$Q_1 = P + Q_2 \tag{1}$$

$$Q_2 = \left[1.786\left(\frac{H}{D}\right) + 0.607\right]P \tag{2}$$

$$T_P = W + \left[\frac{\gamma}{2}D^2 Kp + Q_1 + Q_{2'}\right]\tan\delta \tag{3}$$

$$\Delta T_P = (Q_1 + Q_2)\tan\delta \tag{4}$$

wherein:

P=lateral load $Q_1$, $Q_2$=horizontal pile reaction forces due to P

H=distance from P to ground surface

D=pile length in ground $T_P$=uplift resistance of pile with P acting $T_O$=$T_P$ when P=0

W=self weight of pile p=pile perimeter

K=horizontal (lateral) stress ratio

δ=pile/soil friction angle

γ=soil unit weight (density)

Test examples have been performed that verify the analytical procedure described above for estimating increases in load capacity when lateral loads are applied. In particular, the following examples show that the application of a horizontal load on a buried pile or a drilled shaft (bored pile) foundation can substantially increase the axial uplift capacity of a vertical pile or shaft in frictional soils. This increase can make it unnecessary to add axial capacity, or reduce the magnitude of added capacity, to counteract the foundation moment increase resulting from the lateral load. The analysis method based on Rutledge i.d. assumes that the forces producing the lateral loading do not also produce a significant degradation of the soil's resistance to lateral loading, for example by transient earthquake loads producing temporary liquefaction.

Although the test examples involve upward movement of the pile, the increased frictional side shear due to the lateral loading can also act with the pile loaded in compression and moving downward. A similar percent increase from a lateral loading can be expected, and a greater magnitude of unit side shear in compression versus tension can be expected. As a result, it is possible that the additional axial capacity due to natural or deliberate lateral loading may lower foundation costs.

The axial capacity increases due to lateral loading can apply to any lateral loading, any pile type, any pile size, and any pile inclination and can occur by deliberate initial application as well as from natural events. However, the axial capacity increases may not apply fully to driven displacement piles wherein high initial lateral stresses result from the driving displacements. The added lateral load stresses may just add and subtract from the initial and produce little or no increase in the total lateral force against the pile and thus also in its axial capacity.

Example: 32 mm Embedded Demonstration Pile

The first test example is a pullout test on an embedded model pipe pile. This test example demonstrates up to a 400% increase in axial uplift capacity.

Figure 4A:
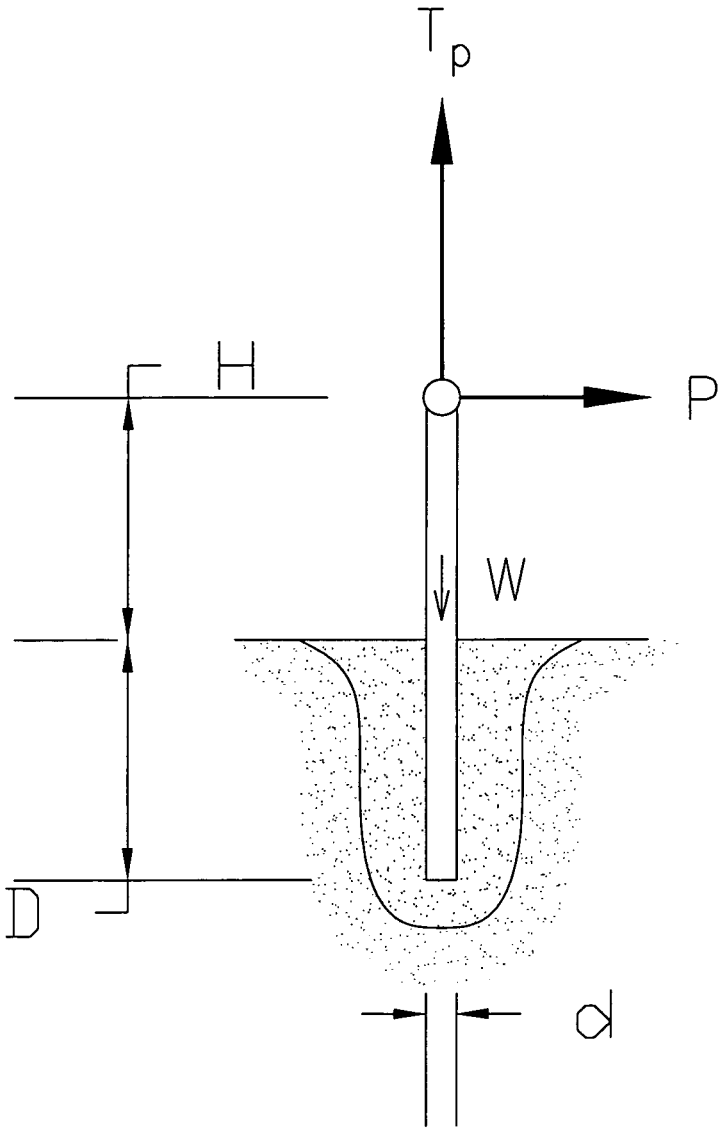
FIGS. 4A and 4B show the geometry and results from a test example in accordance with an embodiment of the subject invention.
Figure 4B:
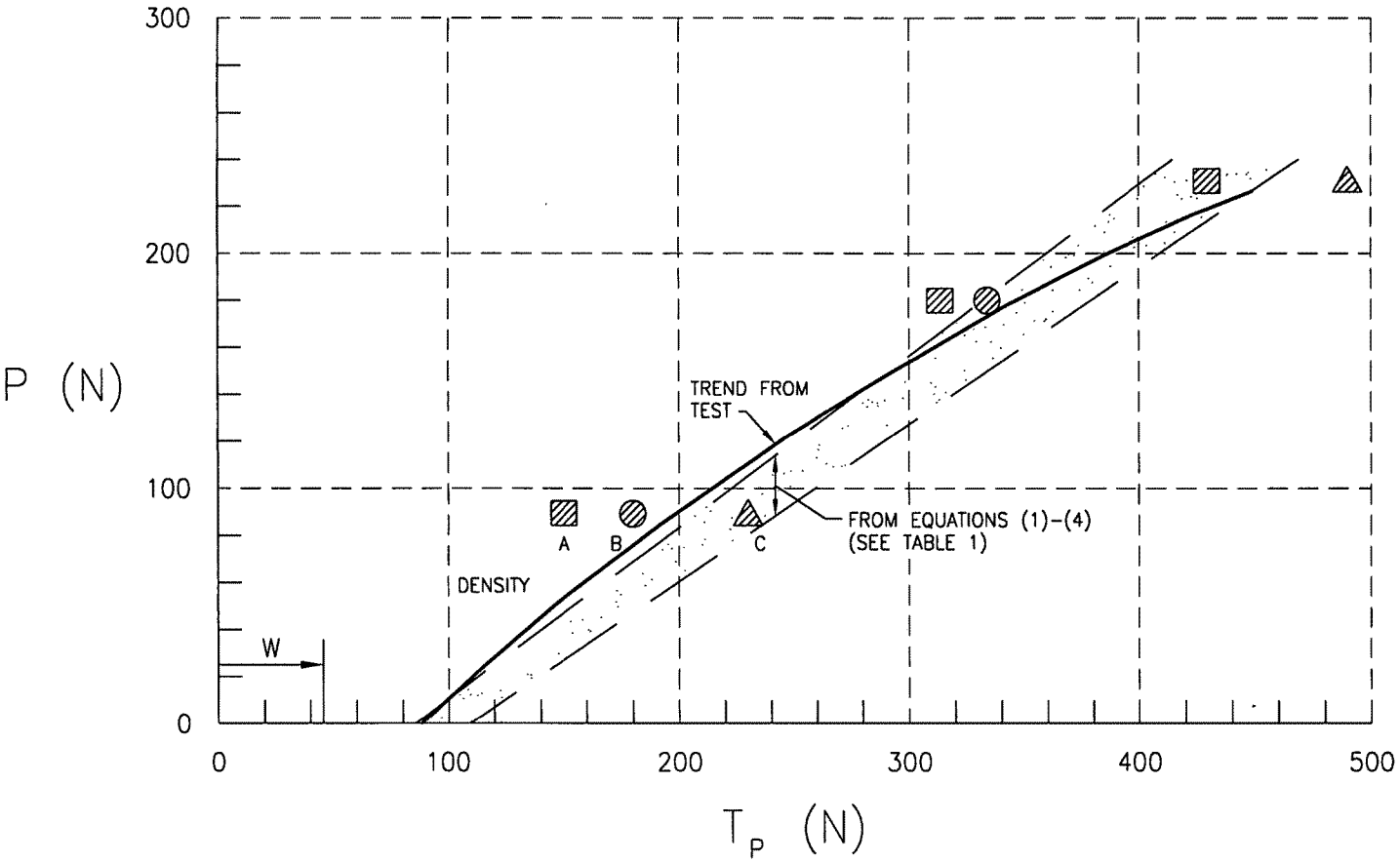

A 32 mm (1.25") diameter, hollow galvanized steel pipe, was placed vertically in a posthole and backfilled with a well graded, clean, quartz sand. Vertical and horizontal wires, each with an inline spring scale, allowed the approximately independent application and measurement of vertical and horizontal loads on the pile. FIG. 4A shows the geometry and FIG. 4B summarizes the results. Table 1 shows some numerical details and includes the results from calculations using Equations (1)-(4). Table 1 lists the input values in these equations and the comparative results from this example. FIG. 4B includes a predicted increase in T as P increases, which closely matches the results. According to FIG. 4B and Table 1, as the lateral force P is increased to its maximum test value (50 lbf), the force in addition to the pile's own weight required to lift the pile out of the ground increases by a factor of about nine. This result exceeds the more conservative expectation based on Equations (1)-(4).

The demonstration of pullout resistance vs. lateral loading was performed using three different sand densities, denoted as A, B and C. At each density, a succession of constant horizontal loads (P) were applied while increasing vertical loading ($T_P$) until the pile slipped upward at least 5 mm (0.2 in). The demonstration using density A involved first placing the pipe in a posthole and then pouring dry sand around the pipe to fill the hole with loose sand. The first and last test at each density, γ, measured only the pullout resistance with P=0, or $T_o$. After the density A sequence of tests, the pile was replumbed and the surrounding sand was densified by back-forth, side-side movement of the pipe to produce noticeable settlement of the poured sand surface.

The B sequence refers to the subsequent loading sequence at this higher density. For the C sequence, the pipe was again replumbed and the sand was further densified by vibrations produced by hammer blows on the pipe. This again created noticeable additional sand surface settlement. The final loading sequence was then performed at density C.

The sand successively densified and increased K in densities A, B, and C but the actual density γ, K, and tan δ changes remain unknown. Trials of (Kγ tan δ) to match $T_P$ when P=0 can be performed to obtain an initial compatible set of values. To provide some verification of the successive densification and increase in (Kγ tan δ) of the sand, the horizontal movement of the top of the pile was measured. The maximum P=223 N (50 lbf) at density A produced a horizontal movement=84 mm, density B=51 mm, and density C=25 mm. After reducing P to zero the measurements showed final horizontal movements at density A=69 mm, B=33 mm, and C=13 mm.

Referring again to FIG. 4B, the pile showed similar relatively small changes in $T_P$ vs. P behavior at all 3 densities. This suggests that the sequential increases in (Kγ tan δ) had only secondary effects.

Figure 9:
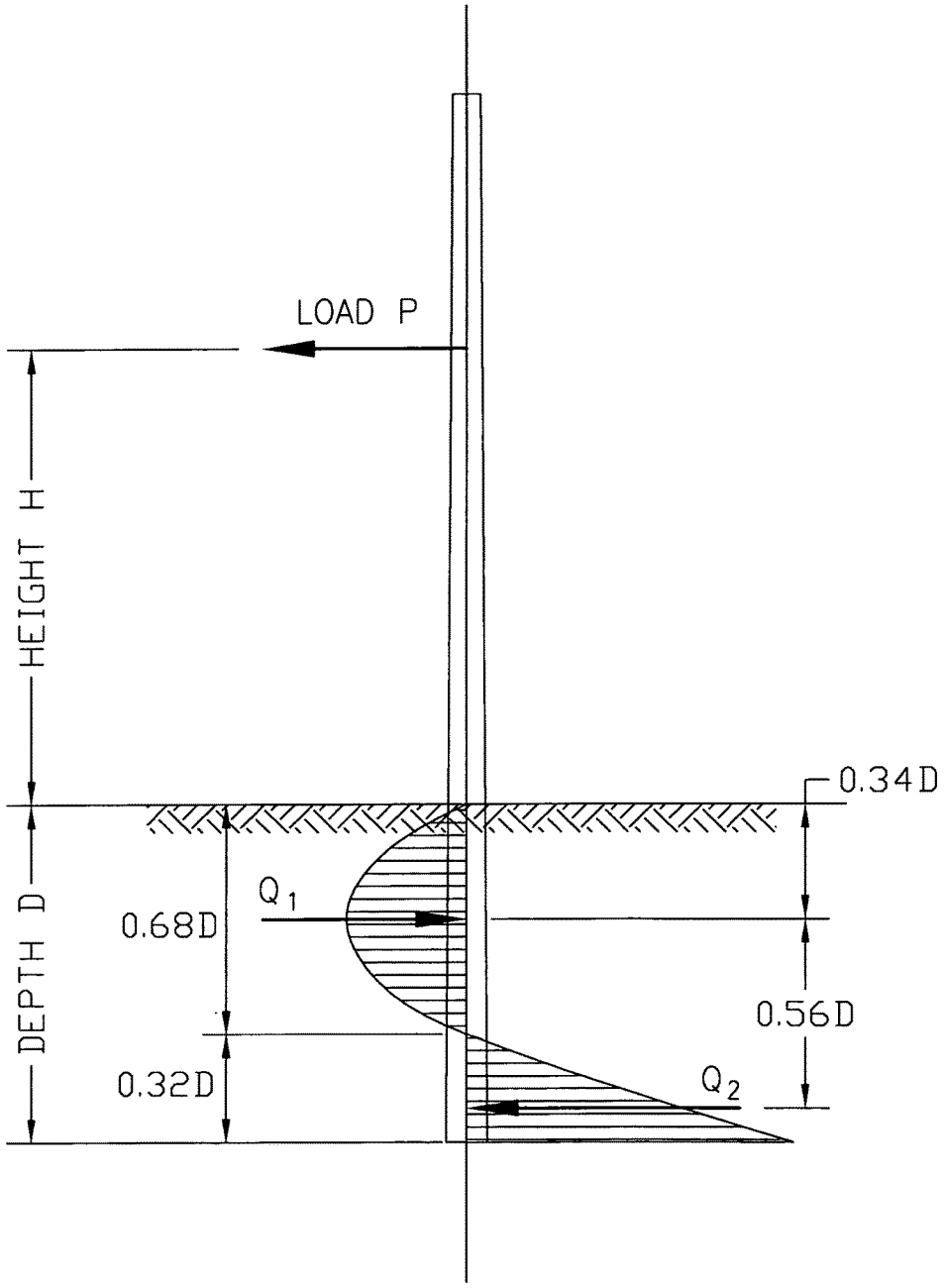
FIG. 9 shows additional lateral pressure distribution and forces acting on a rigid pole according to the Rutledge reference.

Rutledge's design procedure and equations apply specifically to the design of pole pile lateral support for outdoor advertising signs. But, as shown in Table 1 and FIG. 9, it appears that the method can be extended, in an embodiment, to compute the approximate enhanced uplift capacity of Example 1. FIG. 9 illustrates the $Q_1$ and $Q_2$ forces on the buried pole needed to counteract the applied moment PH. Equations (1) and (2) give the values of $Q_1$ and $Q_2$. Equation (3) gives to total axial uplift capacity $T_P$, and Equation (4) the $\Delta T_P$ part due to the lateral load. Equations (3) and (4) provide a new, enhanced use of the Rutledge nomograph.

All patents, patent applications, provisional applications, and publications referred to or cited herein are incorporated by reference in their entirety, including all figures and tables, to the extent they are not inconsistent with the explicit teachings of this specification.

It should be understood that the examples and embodiments described herein are for illustrative purposes only and that various modifications or changes in light thereof will be suggested to persons skilled in the art and are to be included within the spirit and purview of this application.

TABLE 1

EXAMPLE 1 DEMO TEST RESULTS

| | | DENSITY A | | | | DENSITY B | | | | DENSITY C | | | |
|---|---|---|---|---|---|---|---|---|---|---|---|---|---|
| W (lbf) | 10 | | | | | | | | | | | | |
| d (ft) | 0.104 | | | | | | | | | | | | |
| p (ft) | 0.327 | | | | | | | | | | | | |
| γ (lbf/ft$^3$) | 80 | | | | | 85 | | | | 90 | | | |
| K | 0.33 | | | | | 0.40 | | | | 0.50 | | | |
| tan δ | 0.25 | | | | | 0.25 | | | | 0.25 | | | |
| D (ft) | 3.11 | | | | | 2.84 | | | | 2.86 | | | |
| H (ft) | 2.76 | | | | | 3.03 | | | | 3.05 | | | |
| P (lbf) | 0 | 20 | 40 | 50 | 0 | 0 | 20 | 40 | 50 | 0 | 0 | 20 | 50 | 0 |
| meas net $T_o$ (lbf) | 5 | | | | 10 | 10 | | | | 15 | 15 | | | 5 |
| calc net $T_o$ (lbf) | 10 | | | | | 11 | | | | | 15 | | | |
| meas net $T_P$ (lbf) | | 30 | 65 | 85 | | | 25 | 60 | 85 | | | 40 | 100 | |
| calc net $T_P$ (lbf) | | 37 | 64 | 78 | | | 41 | 71 | 86 | | | 45 | 90 | |
| Ratio $(T_p - T_o)/T_o$ | | | | | | | | | | | | | | |
| meas | | 3.0 | 7.7 | 10.3 | | | 2.3 | 7.0 | 10.3 | | | 3.0 | 9.0 | |
| calc | | 2.7 | 5.4 | 6.8 | | | 2.7 | 5.5 | 6.8 | | | 2.0 | 5.0 | |

Notes:
1. P and $T_P$ measurement precision ±5 lbf
2. γ, K and tan δ adjusted by trial so that meas $T_o \approx$ calc $T_o$
3. Test performed and reported in lbf-ft units. 1 lbf = 4.45 N 1 ft = 0.305 m
4. Calculations based on Equations (1) to (4)
5. Using average $T_o$

We claim:

1. A method for increasing the load capacity of a foundation, comprising:

positioning a plurality of piles in a material, wherein each pile of the plurality of piles is positioned individually in the material, such that a bottom portion of each pile of the plurality of piles is located in the material;

applying at least two lateral forces to a corresponding at least two piles of the plurality of piles, wherein a first one or more piles of the at least two piles is used to apply a first lateral force of the at least two lateral forces to a first pile of the at least two piles by the first one or more piles pulling or pushing on the first pile of the at least two piles, wherein a second one or more piles of the at least two piles is used to apply a second lateral force of the at least two lateral forces to a second pile of the at least two piles by the second one or more piles pulling or pushing on the second pile of the at least two piles, wherein applying the at least two lateral forces to the corresponding at least two piles increases a load capacity of the plurality of piles; and incorporating the plurality of piles into a foundation while applying the at least two lateral forces to the at least two piles of the plurality of piles, wherein the foundation increases a load capacity of the foundation by incorporating the plurality of piles into the foundation while applying the at least two lateral forces to the at least two piles of the plurality of piles, wherein the first one or more piles of the at least two piles used to apply the first lateral force of the at least two lateral forces to the first pile of the at least two piles is the second pile, wherein the second one or more piles of the at least two piles used to apply the second lateral force of the at least two lateral forces to the second pile of the at least two piles is the first pile, wherein the first lateral force and the second lateral force are in different directions, and wherein the first pile and the second pile are pushed away from each other, such that a gap between a first vertical position on the first pile where the first lateral force of the at least two lateral forces is applied to the first pile of the at least two piles, and a second vertical position on the second pile of the at least two piles where the second lateral force of the at least two lateral forces is applied to the second pile of the at least two piles increases.

2. A method for increasing the load capacity of a foundation, comprising:

positioning a plurality of piles in a material, wherein each pile of the plurality of piles is positioned individually in the material, such that a bottom portion of each pile of the plurality of piles is located in the material, wherein each pile of the plurality of piles is positioned individually in the material, such that each pile of the plurality of piles is not in contact with any other pile of the plurality of piles and a bottom portion of each pile of the plurality of piles is located in the material;

applying at least two lateral forces to a corresponding at least two piles of the plurality of piles, wherein a first one or more piles of the at least two piles is used to apply a first lateral force of the at least two lateral forces to a first pile of the at least two piles by the first one or more piles pulling or pushing on the first pile of the at least two piles, wherein a second one or more piles of the at least two piles is used to apply a second lateral force of the at least two lateral forces to a second pile of the at least two piles by the second one or more piles pulling or pushing on the second pile of the at least two piles, and wherein applying the at least two lateral forces to the corresponding at least two piles increases a load capacity of the plurality of piles;

incorporating the plurality of piles into a foundation while applying the at least two lateral forces to the at least two piles of the plurality of piles, wherein the foundation increases a load capacity of the foundation by incorporating the plurality of piles into the foundation while applying the at least two lateral forces to the at least two piles of the plurality of piles; and applying a load to the foundation, wherein applying the load to the foundation comprises:

(a) applying an upward load to the foundation; or (b) applying a downward load to the foundation, wherein applying a downward load to the foundation comprises applying a downward load to the foundation via:

(i) placing a building on the foundation; or (ii) placing a large structure on the foundation, wherein the method comprises applying the downward load to the foundation, wherein the first one or more piles of the at least two piles used to apply the first lateral force of the at least two lateral forces to the first pile of the at least two piles is the second pile, wherein the second one or more piles of the at least two piles used to apply the second lateral force of the at least two lateral forces to the second pile of the at least two piles is the first pile, and wherein the first lateral force and the second lateral force are in different directions, wherein the first pile and the second pile are pulled toward each other, such that a gap between a first vertical position on the first pile where the first lateral force of the at least two lateral forces is applied to the first pile of the at least two piles and a second vertical position on the second pile of the at least two piles where the second lateral force of the at least two lateral forces is applied to the second pile of the at least two piles decreases.

3. A method for increasing the load capacity of a foundation, comprising:

positioning a plurality of piles in a material, wherein each pile of the plurality of piles is positioned individually in the material, such that a bottom portion of each pile of the plurality of piles is located in the material;

applying at least two lateral forces to a corresponding at least two piles of the plurality of piles, wherein a first one or more piles of the at least two piles is used to apply a first lateral force of the at least two lateral forces to a first pile of the at least two piles by the first one or more piles pulling or pushing on the first pile of the at least two piles, wherein a second one or more piles of the at least two piles is used to apply a second lateral force of the at least two lateral forces to a second pile of the at least two piles by the second one or more piles pulling or pushing on the second pile of the at least two piles, wherein applying the at least two lateral forces to the corresponding at least two piles increases a load capacity of the plurality of piles; and incorporating the plurality of piles into a foundation while applying the at least two lateral forces to the at least two piles of the plurality of piles, wherein the foundation increases a load capacity of the foundation by incorporating the plurality of piles into the foundation while applying the at least two lateral forces to the at least two piles of the plurality of piles, and wherein incorporating the plurality of piles into the foundation while applying the at least two lateral forces to the at least two piles of the plurality of piles increases the load capacity of the foundation such that a ratio $(T_C-T_O)/T_O$ is in a range from 2.3 to 10.3, where $T_C$ is the load capacity of the foundation and $T_O$ is a load capacity of the foundation incorporating the plurality of piles into the foundation without applying the at least two lateral loads; and applying a downward load to the foundation, wherein applying the at least two lateral forces to the corresponding at least two piles of the plurality of piles comprises:

applying a tensioning force to a tensioning strand interconnected between the first pile of the at least two piles and the second pile of the at least two such that the first lateral load is applied to the first pile and the second lateral load is applied to the second pile; and constructing a pile cap around the first pile and second pile, wherein the pile cap locks in the first lateral load applied to the first pile and locks in the second lateral load applied to the second pile.

4. The method according to claim 3, wherein applying the at least two lateral forces to the corresponding at least two piles of the plurality of piles further comprises:

installing a first bearing collar on a first pile;

installing a second bearing collar on a second pile;

connecting the first bearing collar of the first pile to the second bearing collar of the second pile with the tensioning strand; and locking the tensioning strand in place with one or more anchors after applying the tensioning force to the tensioning strand.

5. A method for increasing the load capacity of a foundation, comprising:

positioning a plurality of piles in a material, wherein each pile of the plurality of piles is positioned individually in the material, such that a bottom portion of each pile of the plurality of piles is located in the material;

applying at least two lateral forces to a corresponding at least two piles of the plurality of piles, wherein a first one or more piles of the at least two piles is used to apply a first lateral force of the at least two lateral forces to a first pile of the at least two piles by the first one or more piles pulling or pushing on the first pile of the at least two piles, wherein a second one or more piles of the at least two piles is used to apply a second lateral force of the at least two lateral forces to a second pile of the at least two piles by the second one or more piles pulling or pushing on the second pile of the at least two piles, wherein applying the at least two lateral forces to the corresponding at least two piles increases a load capacity of the plurality of piles; and incorporating the plurality of piles into a foundation while applying the at least two lateral forces to the at least two piles of the plurality of piles, wherein the foundation increases a load capacity of the foundation by incorporating the plurality of piles into the foundation while applying the at least two lateral forces to the at least two piles of the plurality of piles;

constructing a corresponding individual pile cap for each pile of the plurality of piles, wherein each individual pile cap comprises a tensioning strand conduit, and wherein applying the at least two lateral forces to the corresponding at least two piles of the plurality of piles comprises:

threading a tensioning strand through a first tensioning strand conduit of a first pile cap of the first pile and a second tensioning strand conduit of a second pile cap of the second pile;

attaching a first bearing plate to a first end of the tensioning strand and the first pile cap;

attaching a second bearing plate to a second end of the tensioning strand and the second pile cap;

applying a tensioning force to the tensioning strand such that the first lateral load is applied to the first pile and the second lateral load is applied to the second pile; and locking the tensioning strand in place with one or more anchors and/or grouting.

6. The method according to claim 5, wherein applying a tensioning force to the tensioning strand closes a gap between the first pile cap and the second pile cap.

7. A method for increasing the load capacity of a foundation, comprising:

positioning a plurality of piles in a material, wherein each pile of the plurality of piles is positioned individually in the material, such that a bottom portion of each pile of the plurality of piles is located in the material, wherein each pile of the plurality of piles is positioned individually in the material, such that each pile of the plurality of piles is not in contact with any other pile of the plurality of piles and a bottom portion of each pile of the plurality of piles is located in the material;

applying at least two lateral forces to a corresponding at least two piles of the plurality of piles, wherein a first one or more piles of the at least two piles is used to apply a first lateral force of the at least two lateral forces to a first pile of the at least two piles by the first one or more piles pulling or pushing on the first pile of the at least two piles, wherein a second one or more piles of the at least two piles is used to apply a second lateral force of the at least two lateral forces to a second pile of the at least two piles by the second one or more piles pulling or pushing on the second pile of the at least two piles, and wherein applying the at least two lateral forces to the corresponding at least two piles increases a load capacity of the plurality of piles;

incorporating the plurality of piles into a foundation while applying the at least two lateral forces to the at least two piles of the plurality of piles, wherein the foundation increases a load capacity of the foundation by incorporating the plurality of piles into the foundation while applying the at least two lateral forces to the at least two piles of the plurality of piles; and applying a load to the foundation, wherein applying the load to the foundation comprises:

(a) applying an upward load to the foundation; or (b) applying a downward load to the foundation, wherein applying a downward load to the foundation comprises applying a downward load to the foundation via:

(i) placing a building on the foundation; or (ii) placing a large structure on the foundation, wherein the method comprises applying the downward load to the foundation, wherein applying the at least two lateral forces to the corresponding at least two piles of the plurality of piles comprises:

applying a tensioning force to a tensioning strand interconnected between the first pile of the at least two piles and the second pile of the at least two such that the first lateral load is applied to the first pile and the second lateral load is applied to the second pile; and constructing a pile cap around the first pile and second pile, wherein the pile cap locks in the first lateral load applied to the first pile and locks in the second lateral load applied to the second pile.

8. The method according to claim 7, wherein applying the at least two lateral forces to the corresponding at least two piles of the plurality of piles further comprises:

installing a first bearing collar on a first pile;

installing a second bearing collar on a second pile;

connecting the first bearing collar of the first pile to the second bearing collar of the second pile with the tensioning strand; and locking the tensioning strand in place with one or more anchors after applying the tensioning force to the tensioning strand.

* * * * *